United States Patent [19]

Andersen et al.

[11] 4,149,129

[45] Apr. 10, 1979

[54] CONTACT CONTROL ASSEMBLY FOR A CIRCUIT BREAKER

[75] Inventors: Paul R. Andersen; Rodney C. Kramer, both of Cedar Rapids, Iowa

[73] Assignee: Square D Company, Park Ridge, Ill.

[21] Appl. No.: 804,694

[22] Filed: Jun. 8, 1977

[51] Int. Cl.[2] ..... H01H 73/02

[52] U.S. Cl. ..... 335/21; 335/176; 335/193; 335/201

[58] Field of Search ..... 335/21, 22, 23, 24, 335/42, 45, 172, 173, 174, 175, 176, 16, 157, 158, 193, 192, 201, 46; 200/288

[56] References Cited

U.S. PATENT DOCUMENTS

| | | | |
|---|---|---|---|
| 1,053,489 | 2/1913 | Frost | 335/193 |
| 3,588,412 | 6/1971 | Koennecke et al. | 200/288 |
| 3,849,619 | 11/1974 | Patel | 335/46 |
| 3,943,473 | 3/1976 | Khalid | 335/16 |

*Primary Examiner*—Harold Broome

*Attorney, Agent, or Firm*—Norton Lesser; Richard T. Guttman

[57] ABSTRACT

The following specification describes a magnetic assembly for use in controlling the main contacts of a circuit breaker. The magnetic assembly includes a yoke, an armature for attraction to the yoke to move an operating lever and a pivotable adjustment arm. The lever operates the trip crossbar, which opens the main contacts and is in turn pivotably carried by the adjustment arm. One end of the operating lever is held against longitudinal movement relative the trip crossbar, when the adjustment arm is pivoted to calibrate the circuit breaker. The lever therefore pivots on the adjustment arm to move the armature towards or from the yoke to control the armature air gap without altering the lever travel distance to the crossbar. The armature is also mounted on the lever for relatively linear movement in relationship to the yoke. The main contacts include a stationary contact, which is engaged by the mass of a spring supported floating arc quenching magnet that serves to absorb the shock of contact closure for reducing contact bounce.

22 Claims, 6 Drawing Figures

CONTACT CONTROL ASSEMBLY FOR A CIRCUIT BREAKER

BACKGROUND OF THE INVENTION

1. Field of the Invention

This invention relates in general to contact control assemblies for use in circuit breakers and more particularly to a circuit breaker magnetic assembly having improved adjustment means for controlling the armature air gap of the magnetic assembly and to an improved contact support.

2. Summary of the Prior Art

In U.S. Pat. No. 3,943,473 and related patents, a magnet assembly for controlling the main contacts of the circuit breaker having a current limiter was disclosed. The magnetic assembly utilized an armature pivotally secured to a magnetically permeable yoke and an extended end on the armature operated the trip crossbar to open the main contacts of the breaker in response to moderate overcurrent conditions.

The armature air gap was adjusted by a screw extending through the bottom wall of the breaker to move the armature against the bias of a spring, towards or from the yoke, however when the armature was moved to adjust the air gap the distance between the armature end and the trip crossbar varied correspondingly. The result was that for circuit breakers requiring different current ratings before tripping the crossbar, varying the gap between the armature and trip crossbar in accordance with the current rating altered the travel distance and therefore time in which the bar was tripped. Thus the time interval for tripping the breaker in response to a selected fault or overcurrent varied in accordance with the breaker rating.

In addition the main contacts included a substantially stationary adjustably positioned contact that was supported by a coil spring. This led to contact bounce and arcing on reclosure of the contacts as the stationary contact reacted to the relatively large contact reclosing shock or forces.

SUMMARY OF THE INVENTION

In the present invention, it is proposed to utilize a magnetic assembly for opening the main contacts of a circuit breaker within substantially the same time interval irrespective of the breaker rating.

This accomplished by the provision of a pivotable adjustment arm which in turn pivotally carries a trip crossbar operating lever and an independently movable armature. The adjustment arm pivot is located adjacent the trip crossbar and the lever pivot is located in an adjacent position. When the arm is pivoted by movement of an adjustment screw to adjust the armature air gap, the lever is held from translation and pivots about its pivot on the adjustment arm without altering its distance from the trip crossbar. The armature is carried by the lever for linear movement relative the yoke and at a substantial distance from the pivot so that as the lever pivots, the armature moves through a relatively large distance, while maintaining substantially equal spacing between the armature periphery and the yoke. Thus the armature air gap is uniformly adjusted through a large distance, while maintaining the distance between the lever and trip crossbar substantially constant. This in turn enables the main contacts of the breaker to be opened in substantially the same time interval irrespective of the armature air gap which is set in accordance with the breaker current rating.

Advantage is also taken of the mass of the floating magnet utilized to quench the arc generated at the main contacts to absorb the shock of contact closure. One contact of the main contacts is spring supported and engaged by the magnet which in turn is supported by a leaf spring. On contact closure, the moving contact of the main contacts engages the spring supported contacts and the shock is transmitted through the one contact to the mass of the magnet. The magnet then moves to absorb the shock, while the spring supported contact simply transmits the shock without separating from the moving contact to thereby avoid contact bounce.

It is therefore an object of the present invention to provide an improved contact control assembly for the main contacts of a circuit breaker.

It is another object of the present invention to provide an improved magnetic assembly for operating the trip crossbar of a circuit breaker.

It is another object of the present invention to provide an improved adjustment arrangement for use in calibrating the magnetic assembly of a current limiting circuit breaker.

It is still another object of the present invention to provide an improved main contact assembly for a circuit breaker.

A further object of the present invention is to provide an improved assembly for avoiding contact bounce in a circuit breaker.

Other objects and features of the present invention will become apparent on examination of the following specification and claims together with the accompanying drawings.

BRIEF DESCRIPTION OF THE DRAWINGS

FIG. 7 is a top elevational view of the blade assembly.

FIG. 8 is a sectional view of the blade assembly taken generally along the line 8—8 in FIG. 7; and FIG. 9 is a sectional view taken generally along the line 9—9 in FIG. 8.

DESCRIPTION OF THE PREFERRED EMBODIMENT

Figure 1:
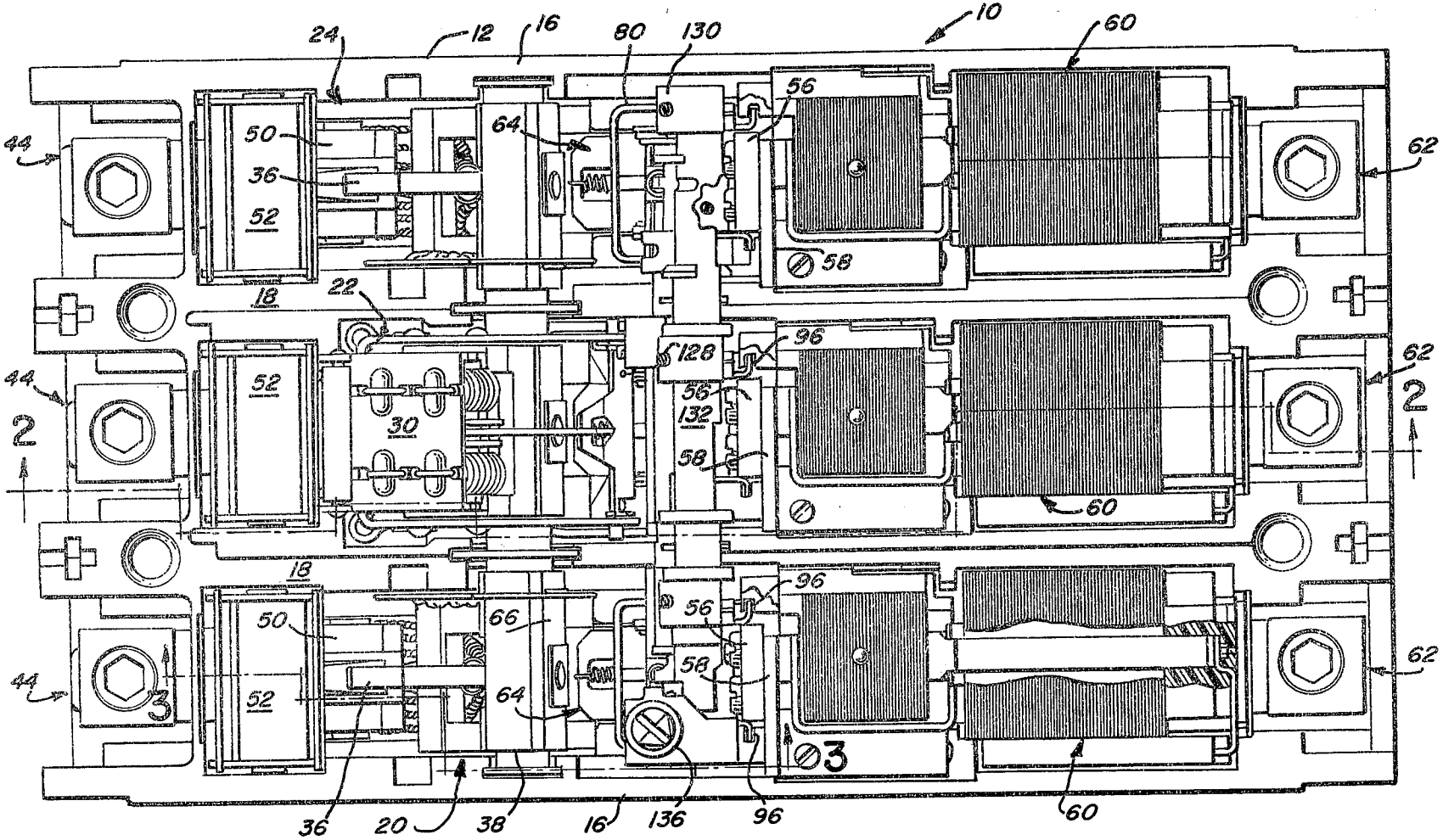
FIG. 1 is a top elevational view of the base assembly of a molded case current limiting circuit breaker incorporating the principles of the present invention.
Figure 2:
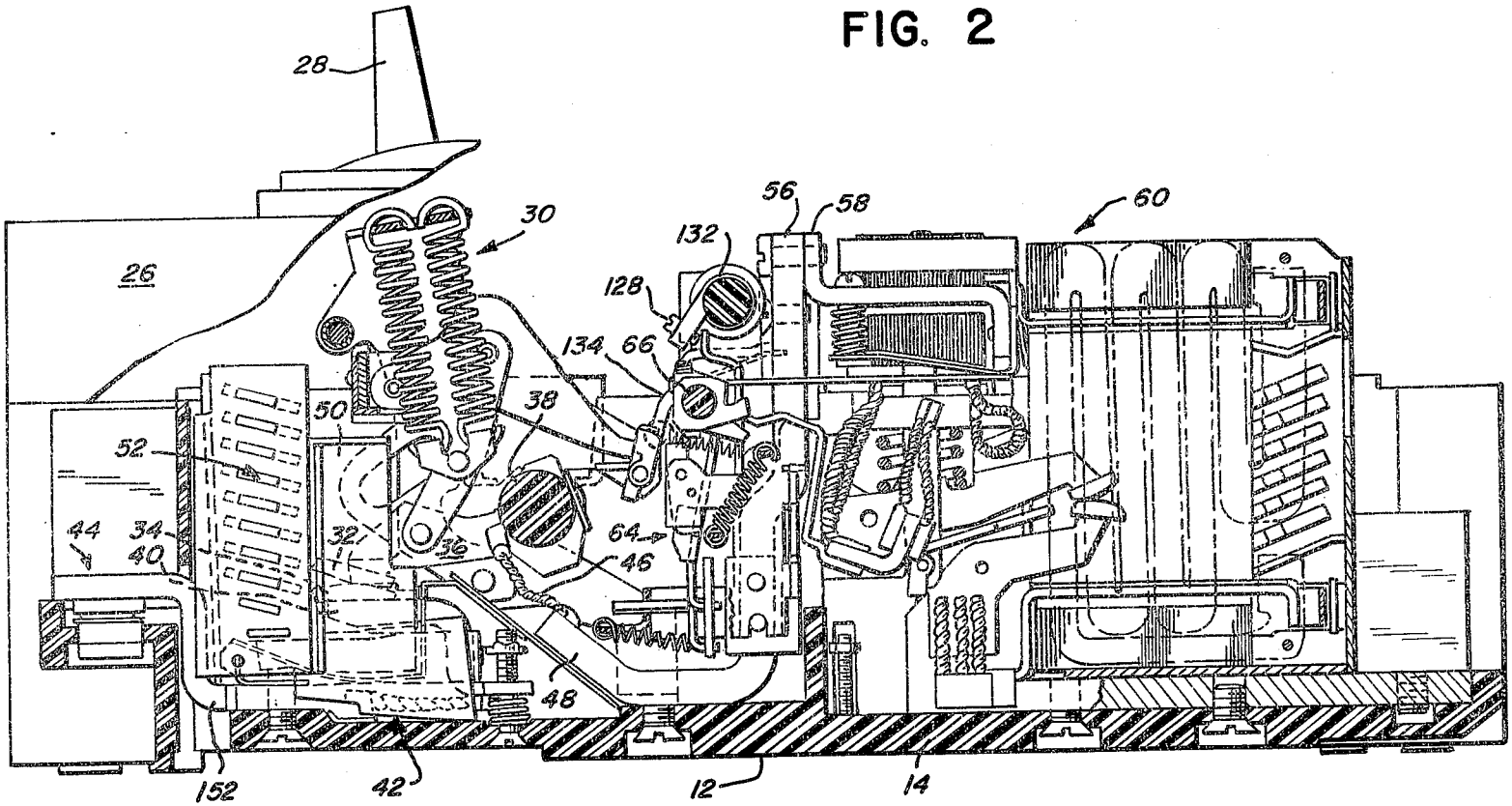
FIG. 2 is a sectional view of the circuit breaker taken along the line 2—2 in FIG. 1.
Figure 3:
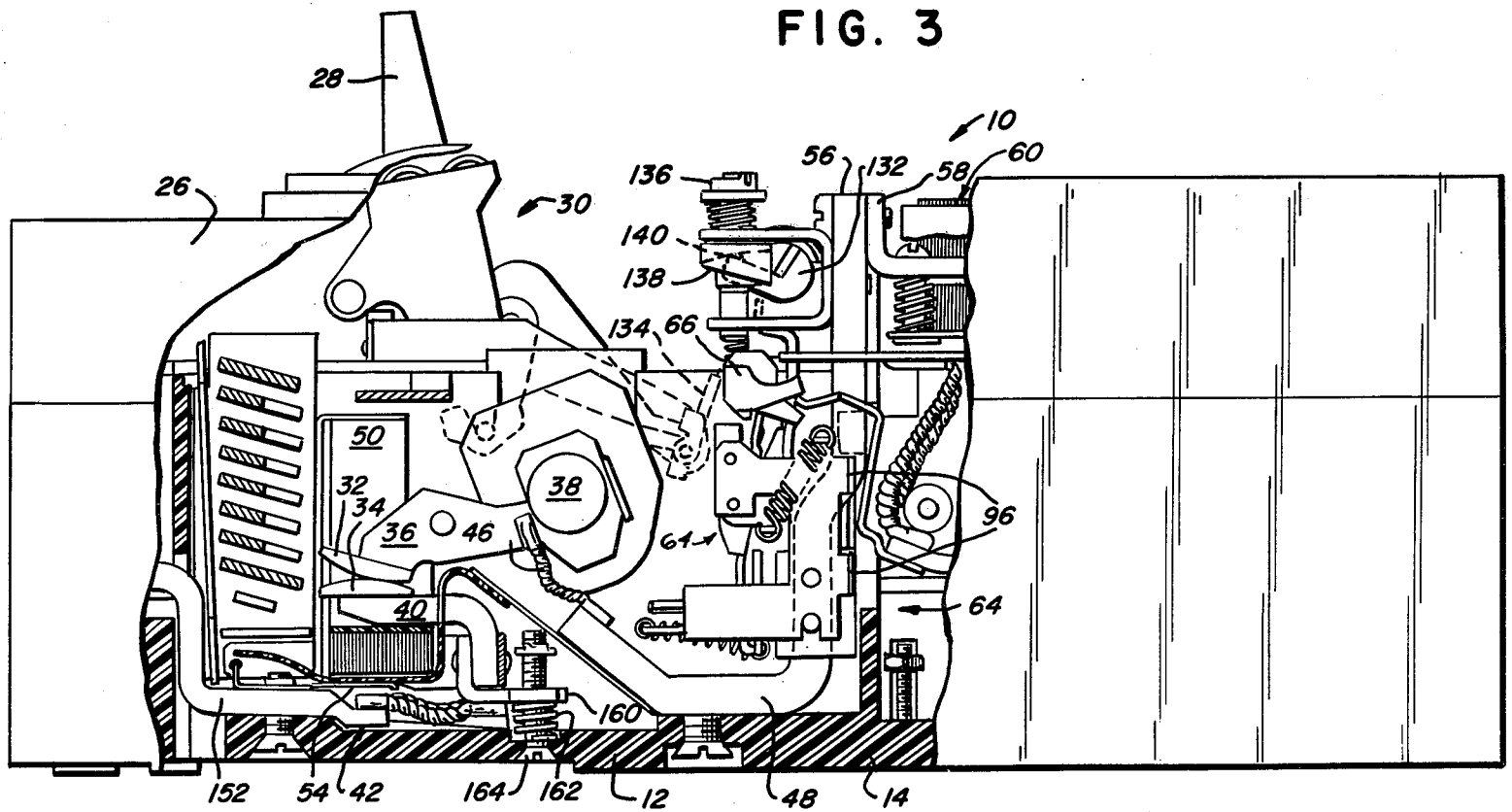
FIG. 3 is a sectional view taken along the line 3—3 in FIG. 1.

In FIGS. 1, 2, and 3 a relevant portion of a multi-pole molded case current limiting circuit breaker for use in a multi-phase circuit is indicated generally by the reference character 10.

The breaker 10 is provided with a lower molded case, 12, having a bottom wall 14 on which are located spaced vertical side walls 16 and spaced intermediate walls 18 to divide the breaker into a longitudinally extending compartment 20, 22 and 24 for each phase.

The circuit breaker 10 includes a cover 26 (shown broken away in FIG. 2) through which an operating handle 28 extends for controlling an operating assembly 30 in the center compartment 22 to reset the main contacts 32 and 34 of the breaker after the contacts are opened by assembly 30 in response to either an overheat or overcurrent condition or a high fault current. As set forth in the aforementioned patent, opening contacts 32 and 34 or resetting the contacts under control of the assembly 30 pivots movable blade 36 which carries the contact 32 in each compartment. Each blade 36 is carried by a common blade crossbar 38 and each contact 34 is carried by a spring supported blade 40. Blade 40 forms a portion of a blade assembly 42 and extends a circuit from a conductor (not shown) connected at a terminal assembly 44 located adjacent one end of the respective compartment, through contacts 34 and 32, blade 36, a flexible braided pigtail conductor 46 secured to each blade 36 to a respective conductor 48 of rectangular cross section located adjacent the bottom wall 14 of the breaker.

The contacts 32 and 34 are located between the legs of a U-shaped arc quenching magnet 50 and adjacent a chamber of a conventional arc suppression assembly 52. The contact 34 is a relatively or substantially stationary contact and blade 40 rests upon or is engaged with the back leg of magnet 50. The back leg of the magnet 50 in turn is floatingly supported by a leaf spring 54 as will be explained.

Conductor 48 extends along the bottom wall 14 and then vertically upwardly, as indicated by conductor leg 56 in FIGS. 2 and 3, adjacent the central vertical axis of the compartment. Conductor leg 56 at its upper end is connected to a conductive member 58 for extending the circuit through a respective current limiter assembly 60 for each compartment and to a terminal assembly 62 for the respective compartment and a respective external conductor (not shown) connected to terminal assembly 62. The current limiter assembly 60 may be either of a type set forth in the aforementioned patent or preferably is of the type shown and described in a copending application Ser. No. 804,693, filed June 8, 1977 by Andersen simultaneously herewith.

The circuit breaker 10 further includes a magnetic assembly 64 associated with the vertical leg 56 of conductor 48 in each compartment for operating trip crossbar 66 common to each compartment in response to an overcurrent or fault condition. The trip crossbar 66 is conventionally biased and pivotally supported in the spaced vertical walls forming the compartments of the breaker and has respective trip levers for operation by a bimetal strip and by a current limiting trip lever as set forth in the aforementioned copending accompanying application.

Figure 4:
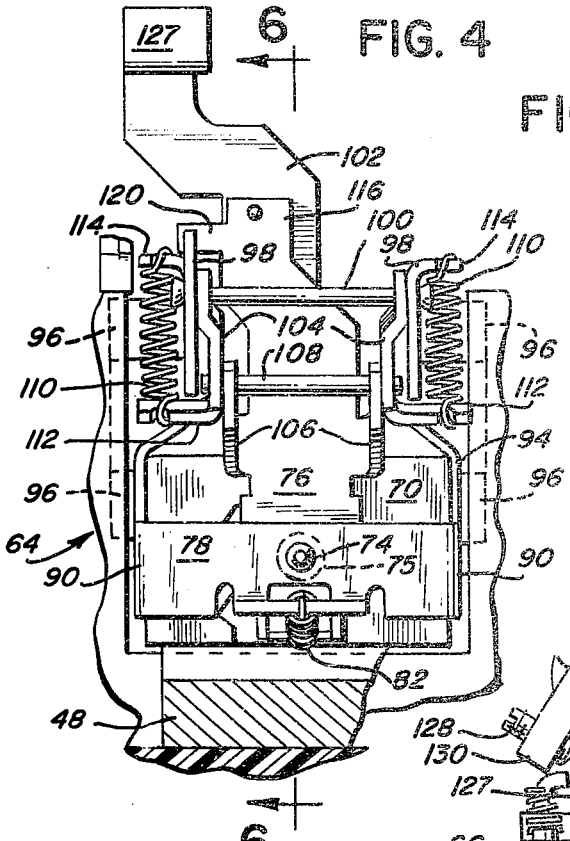
FIG. 4 is a front elevational view of the magnetic assembly.
Figure 6:
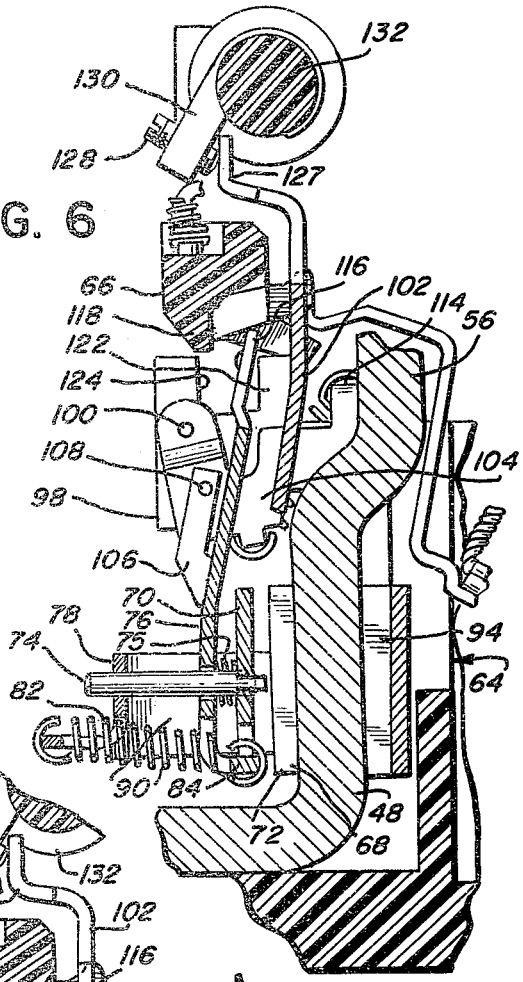
FIG. 6 is a sectional view taken generally along the line 6—6 in FIG. 4.
Figure 5:
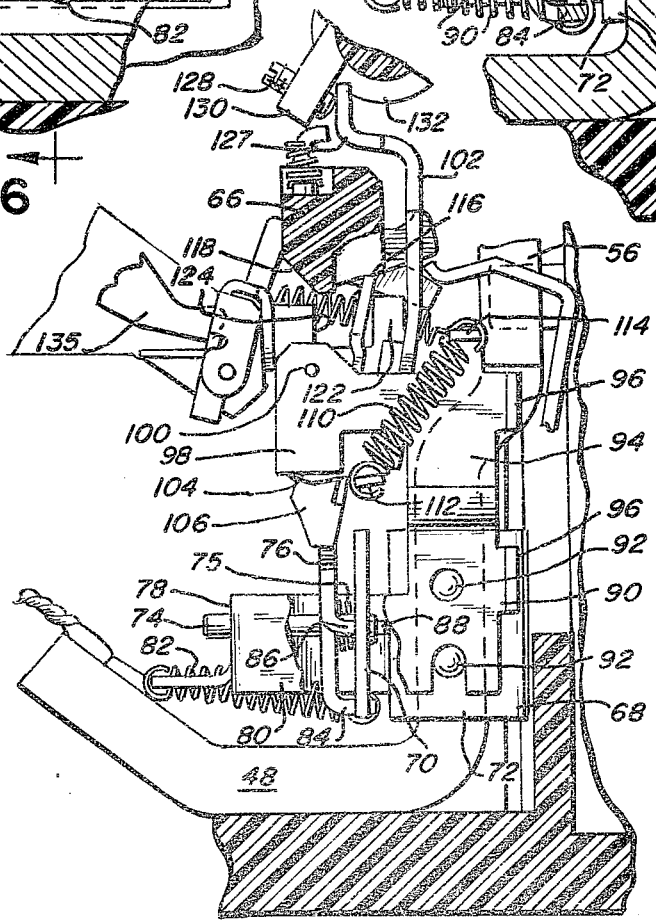
FIG. 5 is a side elevational view of the magnetic assembly.

Each magnetic assembly 64 as best seen in FIGS. 4, 5 and 6 comprises a U shaped magnetically permeable yoke 68 having an armature 70. Armature 70 is formed in a generally rectangular plate-like configuration and extends between the free ends of the legs 72 of yoke 68. The yoke 68 and armature 70 encircle the vertical leg 56 of the conductor 48, which provides a magnetic field for attracting armature 70 to the yoke 68 in response to a selected overcurrent in conductor leg 56.

A pin 74 fixed to armature 70 passes slidably through a coil spring 75, an oversized opening in adjustment lever 76 and through the back leg 78 of a U shaped bracket or support member 80. A spring 82 is connected between a tang on the back leg 78 of member 80 and a bent tang 84 on the lever 76. A pair of additional tangs 86 on lever 76 extend through respective oversize passages in the armature 70 and each has a stop 88 thereon for moving the armature 70 toward leg 78 in response to movement of the lever 76 in that direction and for moving the lever 76 in the direction of yoke 68, when the armature 70 is attracted thereto against the bias of spring 82.

Bracket 80 has side legs 90 extending toward and overlapping the side legs 72 of yoke 68. Spaced bosses 92 on legs 72 secure the yoke 68 to the bracket 80. Projecting bracket arms 94 on the bracket legs 90 have spaced ears 96 received in respective compartment side wall recesses or passages to secure each bracket 80 and associated yoke 68 in the breaker. Each recess is closed or overlapped at its upper end by a side wall tab portion of a housing of the current limiter assembly 60 to secure the assembly 64 in the breaker. The upwardly projecting arms 94 are provided with forwardly projecting fingers 98 through which a pin 100 extends for pivotally supporting a U shaped adjustment arm 102 on bracket 80.

Arm 102 has spaced legs 104 through which pin 100 passes and which nestingly receive a pair of spaced side legs 106 on the lever 76. A pin 108 extends through legs 104 and 106 to pivotally support the lever 76 on the adjustment arm 102 at a position substantially 5/16" below pin 100 with pin 100 spaced substantially midway between the crossbar 66 and the pin 108 and substantially 1" from tangs 86. A pair of springs 110 extend between ears 112 on arm 102 and ears 114 on bracket 80 to bias the arm 102, lever 76 and armature 70 counterclockwise about pin 100, as seen in FIGS. 2, 5 and 6 and normally overcomes the bias of spring 82 to engage armature 70 with the free ends of yoke legs 72. It will be noted that springs 110 act primarily in a substantially vertical direction to pivot pin 108 about pin 100 as pin 108 is located intermediate the pin 100 and ears 112, while spring 82 acts in a substantially horizontal direction so that it may independently bias the armature.

An upwardly extending portion 116 bent into a plane substantially coincident with the free ends of yoke legs 72 is provided on lever 76. Portion 116 is spaced adjacent a trip leg 118 of the trip bar 66 for engagement therewith in response to pivoting movement of the lever 76 by the armature 70 to operate the trip bar 66 and release the operating assembly 30 for opening contacts 32 and 34. A stop member or ear 120 is formed on portion 116 of lever 76 to engage a stop ear 122 on bracket 80 when armature 70 engages yoke 68 under the counterclockwise bias of springs 110 to hold lever portion 116 from moving any further from trip leg 118 during clockwise pivoting of the lever. A stop surface 124 on the bracket 80 stops movement of the lever 76 in response to movement of the armature 70 toward yoke 68 to pivot the lever 76 counterclockwise as will be explained. The bias springs 110 as mentioned above, if unopposed, bias lever 76 counterclockwise about the axis of pin 100 to hold the armature 70 against legs 72. The ear 120 on the portion 116 of lever 76 seat against stop ear or surface 122, since surface 122 is also substantially coincident with the end of yoke legs 72. In this position the portion 116 is a fixed distance from an overcurrent trip arm 118 of trip crossbar 66.

The adjustment arm 102 also extends upwardly between lever portion 116 and the leg 56 of conductor 48. The upper end of arm 102 is provided with an L shaped adjustment tang 127 for engagement with an adjustment screw 128 carried by a leg 130 of a conventional adjustment crossbar 132.

To adjust the air gap between the armature 70 and legs 72 of the yoke or heelpiece 68 for determining the overcurrent level at which the armature 70 is moved, the screw 128 is threaded through leg 130 of adjustment crossarm 132 to rotate arm 102 clockwise about pin 100. This carries pivot pin 108, located intermediate the pin 100 and armature 70 and close to the plane of lever 76, clockwise about pin 100. Ear 120 engaged with surface 122 prevents portion 116 from moving from the trip leg 118, however while lever 76 can pivot about pin 108. Tangs 86 and stops 88 on the lever 76 therefore move clockwise to carry the armature 70 therewith and from the yoke legs. As the lever pivots, the pin 74 slides longitudinally relative the lever and maintains equal spacing of perimeter of armature 70 from yoke 72. The lever 76 during this movement is restrained from movement from trip leg 118 by stop surface 122 and it simply pivots about pin 108 as mentioned to accommodate the movement while ear 120 slides vertically along surface 122. With pin 108 and ear 120 located substantially closer to pin 100 than armature 70, armature 70 travels a substantially large distance compared to the movement of pin 108 and ear 120 to provide a desired air gap with short increments of screw adjustment. When the air gap appears satisfactory, a current test is applied to the breaker.

The circuit breaker is now easily calibrated by simply passing a known overcurrent through conductor 48 to attract armature 70. If the armature is attracted by a current of less value than desired, arm 102 is adjusted by screw 128 to increase the gap while the surface 122 holds the distance between lever 76 and trip leg 118 constant. Alternatively if during calibration, the armature is attracted only by a greater current value than the rated overcurrent, screw 128 is threaded out and, arm 102 pivots counterclockwise under the bias of springs 110. Ear 120 of lever 76 remains seated against surface 122, while the lever pivots counterclockwise in response to the movement of pin 108 to carry the armature close to the yoke for attraction by the selected overcurrent.

On attraction of the armature 70 to the yoke 68 by a selected overcurrent, it pivots the lever 76 counterclockwise and from surface 122 to engage portion 116 with the trip lever 118. The crossbar 66 is therefore pivoted against its spring bias to release the latch 134 of the operating assembly 30, whose spring controlled toggle assembly opens contacts 32 and 34. The breaker can thus be tripped in response to a selected one of a wide variety of overcurrent conditions dependent on the breaker rating with the trip bar 66 operated in the same time interval irrespective of the overcurrent rating of the breaker.

To adjust the position of trip lever 76 and armature 70 in each compartment simultaneously, the adjustment crossbar 132 is rotated by means of the conventional adjustment button 136 having a cam 138. Cam 138 engages an arm 140 on the adjustment crossbar 132 to pivot the crossbar 132 clockwise or counterclockwise respectively dependent on the direction of cam rotation. Pivoting the crossbar 132 counterclockwise pivots arm 102 in each compartment clockwise about pin 100 to adjust the armature position accordingly. Pivoting crossbar 132 clockwise has the opposite effect. Thus the magnetic assemblies 64 may initially be adjusted for one overcurrent value and then all adjusted for a desired value.

The blade assembly 42 is best seen in FIGS. 7, 8 and 9. It includes L shaped blade 40 having a horizontal arm 142 to which contact 34 is secured and a vertical arm 144 secured to the back leg of a U shaped member 146, whose legs extend in the direction of arm 142 and therebelow for receiving a pivot pin or tang 148 on one leg of an L shaped bracket 150. Bracket 150 is secured to the base wall 14 and to a bar conductor 152 extending from terminal assembly 44.

The bar conductor 152 extends beneath a bottom leg of bracket 150 for some distance for sandwiching and supporting leaf spring 54 having a cantilever upwardly extending leg 154 engaging the back leg of U shaped magnet 50. Magnet 50 has a rear rim lamination, which is recessed at the bottom to receive the legs of memger 146. The end of conductor 152 is connected by means of flexible braided conductors 156 to bracket 160 which in turn is connected to arm 144 of blade 42 to extend the electrical connection thereto. A thin flexible shield 158 overlaps the spring 54 and is engaged between the back leg of magnet 50 and the spring and upwardly extending legs thereon sandwich blade arm 142 and overlaps the back leg of member 146.

One leg of arm L shaped bracket 160 is also secured to the back leg of member 146. The other leg of bracket 160 is biased by a spring 162. Spring 162 serves to bias contact 34 against contact 32. Spring leg 154 biases the back leg of magnet 50 against the bottom surface of blade arm 142.

When the breaker tripped by a fault condition the trip crossbar 66 is operated as explained to release the operating assembly 30, which causes blade crossbar 38 to pivot for disengaging contacts 32 and 34. As contact 32 moves from contact 34, contact 34 is moved upwardly under the influence of spring 162 against bracket 160 and blade 40, until bracket 160 engages the stop adjacent the top of screw 164 so that contacts 32 and 34 separate completely. Subsequently when the fault condition is corrected the handle 28 is operated to reset the operating assembly 30 for pivoting the blade crossbar 38 to close the contacts 32 and 34. Blade 36 is pivoted under considerable force of course and when contacts 32 and 34 engage the force is transferred through leg 142 of blade 40 to magnet 50. As magnet 50 is free to move in response to the impact, the inertia is transferred through blade 40, and magnet 50 instead moves downwardly against the pressure of spring 154 to absorb the impact forces. Contacts 32 and 34 therefore remains closed and move downwardly together against the influence of spring 162 to prevent contact bounce, or chatter, as the large heavy magnet was moved instead to absorb the impact forces. When the impact force is dissipated, and the blade 40 is in its normal position, spring 154 holds magnet 50 back against blade 40.

The foregoing constitutes a description of an improved contact control arrangement for a circuit breaker, whose inventive concepts are believed set forth in the accompanying claims.

What we claim is:

1. A contact control assembly for a circuit breaker having a pair of serially connected main circuit breaker contacts operable to a closed position by an operating assembly having an associated trip bar arranged to control said operating assembly to open said contacts in response to movement of said trip bar, the improvement comprising:

a yoke,
an armature for attraction to said yoke,
an adjustment arm,
lever means pivotally supporting said armature on said arm for relative pivotable movement between said arm and said armature,
means pivotally carrying said adjustment arm,
and means for retaining a predetermined distance between said lever means and said trip bar in response to pivotal movement of said adjustment arm to move said armature relative said yoke.

2. The assembly claimed in claim 1 in which said means for retaining said predetermined distance comprises a stop surface engaging said lever means, and means biasing said lever means for rotation in one direction about the pivot of said arm.

3. In the assembly claimed in claim 1, means enabling said armature to move substantially linearly relative said yoke in response to pivotal movement of said arm.

4. A contact control assembly for a circuit breaker having a pair of serially connected main circuit breaker contacts operable to a closed position by an operating assembly having an associated trip bar arranged to control said operating assembly to open said contacts in response to movement of said trip bar, the improvement comprising:
an adjustment arm pivotally supported for rotation about one axis,
a yoke,
a lever pivotally carried on said arm for rotation about a second axis rotatable with said arm about said first axis,
an armature carried by said lever for movement relative said yoke,
means biasing said lever for pivotal movement in one direction about said second axis for moving said armature from said yoke,
means biasing for said adjustment arm for pivotal movement about said first axis to move said arm carrying said lever and armature toward said yoke;
stop means for pivoting said lever about said second axis in response to the rotation of said second axis about said first axis to move said second axis and armature relative said yoke to thereby maintain one portion of said lever a substantially constant distance from said trip bar irrespective of the spacing between said armature and yoke.

5. The assembly claimed in claim 1 in which said stop means includes a bracket for pivotally supporting said adjustment arm, a stop surface on said bracket for engaging one portion said lever, and said biasing means for said arm extends between said bracket and arm for biasing said arm for pivotal movement about said first axis to engage said lever with said stop surface and said armature with said yoke.

6. The assembly claimed in claim 5 in which said first axis is located intermediate said trip bar and said second axis.

7. The assembly claimed in claim 6 in which said stop surface is substantially coincident with said yoke.

8. The assembly claimed in claim 5 in which said first axis is located intermediate said stop surface and said second axis and said lever is spaced intermediate said stop surface and said trip bar.

9. The assembly claimed in claim 8 in which said means biasing said lever includes means biasing said armature in a direction from said yoke for resisting movement of said armature toward said yoke.

10. The assembly claimed in claim 8 in which each biasing means exerts a respective force in a direction transverse to the other force.

11. The assembly claimed in claim 8 in which said means biasing said arm exerts a greater force than the means biasing said lever.

12. In the assembly claimed in claim 11, means extending between said armature and said bracket for enabling linear movement of said armature relative said yoke.

13. The assembly claimed in claim 12 in which said means for enabling linear movement includes a pin fixed to said armature and passing slidably through said lever and bracket with said pin supporting said armature on said lever.

14. In the assembly claimed in claim 13 a coil spring encircling said pin between said lever and armature.

15. In the assembly claimed in claim 14, a pair of tangs on said lever each passing through said armature and having a stop surface to engage said armature for moving said armature in one direction in response to movement of said lever in the one direction.

16. The assembly claimed in claim 1 in which each of said contacts is carried by a respective blade and said operating assembly is adapted to pivot one of said blades in response to movement of said trip bar in one direction and is adapted to pivot said blade in the opposite direction for engaging one of said contacts with the other contact, the improvement comprising a movable large mass in supporting relationship to the other contact for absorbing the shock of engagement.

17. A contact control assembly for a circuit breaker having a pair of serially connected main circuit breaker contacts operable to a closed position by an operating assembly having an associated trip bar arranged to control said operating assembly to open said contacts in response to movement of said trip bar, the improvement comprising:
a yoke,
an armature for attraction to said yoke,
a lever carrying said armature for movement toward said yoke in response to the passage of a predetermined current through said contacts for moving said lever to operate said trip bar,
an adjustment arm pivotally carrying said lever,
means pivotally carrying said adjustment arm,
means biasing said arm for pivotal movement in one direction,
and stop means engaged by said lever for pivoting said lever relative said arm to move said armature relative said yoke and hold said lever a predetermined distance from said trip bar in response to the pivotal movement of said arm to thereby enable the selection of said predetermined current for moving said armature toward said yoke.

18. A contact control assembly for a circuit breaker having a pair of serially connected main circuit breaker contacts operable to an engaged position by an operating assembly having an associated trip bar arranged to control said operating assembly to open said contacts in response to the movement of said trip bar, the improvement comprising:
a pair of blades, each carrying a respective one of said contacts with one blade pivotable in one direction to open said contacts and pivotable by said operating assembly in the opposite direction to engage said contacts, an arc quenching magnetic member associated with said contacts for quenching an arc generated between said contacts; and means resiliently supporting said magnetic member in supporting relationship to the other blade for enabling said magnetic member to absorb the shock created by engagement of the contact carried by said one blade with the other contact.

19. The assembly claimed in claim 18 in which said magnet member is U shaped and said other blade seats between the legs of said magnetic member and upon the back leg of said magnetic member.

20. The assembly claimed in claim 19 in which said means resiliently supporting said magnetic member comprises a spring engaging the back leg of said magnetic member to bias said leg toward said other blade.

21. In the assembly claimed in claim 20, a pivotal support for said other blade, and means biasing said blade toward back leg.

22. In the assembly claimed in claim 21 in which said spring is a leaf spring and is engaged between a bar conductor and said magnetic member.

* * * * *

UNITED STATES PATENT AND TRADEMARK OFFICE

CERTIFICATE OF CORRECTION

PATENT NO. : 4,149,129

DATED : April 10, 1979

INVENTOR(S) : P. R. Andersen and R. C. Kramer

It is certified that error appears in the above-identified patent and that said Letters Patent are hereby corrected as shown below:

Col. 7, line 48, change "claim 1" to read --claim 4--.

Signed and Sealed this

*Twenty-eighth* Day of *October 1980*

[SEAL]

*Attest:*

SIDNEY A. DIAMOND

*Attesting Officer*

*Commissioner of Patents and Trademarks*